US006554631B2

(12) United States Patent
Ishikawa et al.

(10) Patent No.: US 6,554,631 B2
(45) Date of Patent: Apr. 29, 2003

(54) WATERPROOF CONNECTOR WITH BLIND RECESS

(75) Inventors: Ryotaro Ishikawa, Yokkaichi (JP); Hajime Kawase, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/985,163

(22) Filed: Nov. 1, 2001

(65) Prior Publication Data

US 2002/0052142 A1 May 2, 2002

(30) Foreign Application Priority Data

Nov. 1, 2000 (JP) ..... 2000-334294

(51) Int. Cl.[7] ..... H01R 13/52
(52) U.S. Cl. ..... 439/274; 439/587
(58) Field of Search ..... 439/274, 587, 439/588, 275, 279, 589, 271

(56) References Cited

U.S. PATENT DOCUMENTS

| | | | | |
|---|---|---|---|---|
| 4,053,196 A | | 10/1977 | Dunaway | |
| 5,382,174 A | | 1/1995 | Kinoshita | |
| 5,540,450 A | * | 7/1996 | Hayashi et al. | 277/205 |
| 5,562,494 A | * | 10/1996 | Fujiwara | 439/587 |
| 6,100,472 A | | 8/2000 | Foss | |

FOREIGN PATENT DOCUMENTS

| | | |
|---|---|---|
| EP | 644 621 | 3/1995 |
| EP | 694 994 | 1/1996 |

OTHER PUBLICATIONS

Patent Abstract of Japan, vol. 17, No. 91, Feb. 23, 1993,JP 4284383.
Patent Abstract of Japan, vol. 1995, No. 11, Dec. 26, 1995,JP 7201403.
Patent Abstract of Japan, vol. 17, No. 150, Mar. 25, 1993,JP 4315780.

* cited by examiner

*Primary Examiner*—Tho D. Ta
*Assistant Examiner*—Truc Nguyen
(74) *Attorney, Agent, or Firm*—Banner & Witcoff, Ltd.

(57) ABSTRACT

To improve the sealing function of a waterproof connector provided with a collective rubber stopper. Male terminal fittings 21 at ends of electric wires 20 are pushed through electric wire through holes 33 of a collective rubber stopper 30, widening these electric wire through holes 33 while they are being pushed therethrough, and are inserted into corresponding cavities 16. Inner lips 35 of the rubber stopper 30 fit resiliently with outer circumference faces of the electric wires 20, thereby sealing each cavity 16. A ring-shaped groove 37 is formed concentrically around each electric wire through hole 33 at a posterior face of the rubber stopper 30. Inner portions of these grooves 37 form comparatively thin cylindrical members 38, these fitting tightly with the outer circumference of the electric wires 20. Even in the case where a pulling force is exerted on the electric wires 20 when these have been bent at a right angle to their axial direction, the cylindrical members 38 follow the bending of the electric wires 20, thus maintaining a tight and reliable seal between inner circumference faces of the cylindrical members 38 and the outer circumference faces of the electric wires 20.

20 Claims, 3 Drawing Sheets

WATERPROOF CONNECTOR WITH BLIND RECESS

TECHNICAL FIELD

The present invention relates to a waterproof electrical connector and a collective rubber stopper therefor.

BACKGROUND TO THE INVENTION

A prior type of waterproof connector (see FIG. 6 of this specification) is configured as follows: a rubber stopper attachment hole 3 is provided in a posterior face of a connector housing 2 having a plurality of cavities 1 formed therein. This rubber stopper attachment hole 3 covers openings of all the cavities 1. A collective rubber stopper 5, which is fitted into the rubber stopper attachment hole 3, has electric wire through members 4 opening therein, the locations thereof corresponding to the cavities 1. The collective rubber stopper 5 is maintained in position by a rubber stopper pushing member 6. Terminal fittings 8, which have ends of electric wires 7 fixed thereto, are inserted into the cavities 1, widening the electric wire through members 4 of the collective rubber stopper 5 as they are pushed therethrough. Inner circumference faces of the electric wire through members 4 fit tightly and resiliently with outer circumference faces of the electric wires 7, thereby sealing each cavity 1. One example of this type of waterproof connector is described in JP 5-266941.

In the waterproof connector configured as described above, the electric wire 7 (shown in the lower row in FIG. 6) may, due to the waterproof connector being rotated, be led outwards in a manner whereby it is bent at a right angle to its axial direction. If a pulling force is exerted on the electric wire 7 that is in this state, the electric wire 7 will pull, on the side that is bent, on the inner circumference face of the electric wire through member 4, causing it to change shape resiliently and thus become larger, and a space S will be formed between the electric wire 7 and the opposite side of the inner circumference face of the electric wire through member 4. As a result, the seal thereof is compromised.

One means to avoid this problem is to make the rubber stopper 5 thicker. However, in that case, more space is required in which to attach this rubber stopper 5, thus causing the connector to become larger. Furthermore, this leads to greater resistance when inserting the terminal fittings 8 through the electric wire through members 4, thus making this insertion problematic. As a result, an effective solution to this problem is required.

The present invention has taken the above problem into consideration, and aims to improve the sealing function of a waterproof connector provided with a collective rubber stopper.

SUMMARY OF THE INVENTION

According to the invention there is provided a waterproofing stopper for a wire receiving opening of an electrical connector, said stopper comprising a body having an inner side, an outer side and a plurality of holes therethrough, said holes being sized to resiliently engage a respective electrical wire, characterised in that a ring like blind recess surrounds each of said holes at the outer side thereof.

Such a stopper provides that the relatively thin annular portion surrounding each wire can bend therewith; accordingly the risk of moisture entering the connector is reduced.

Preferably the blind recesses extend about halfway through the thickness of the stopper, and in one embodiment the wall thickness of the annular portion surrounding the wire is about the same thickness as the wire itself. This annular portion may be co-moulded of a relatively softer material so as to better follow the curvature of a belt wire, without causing the stopper to become unstable in the connector housing.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Figure 1:
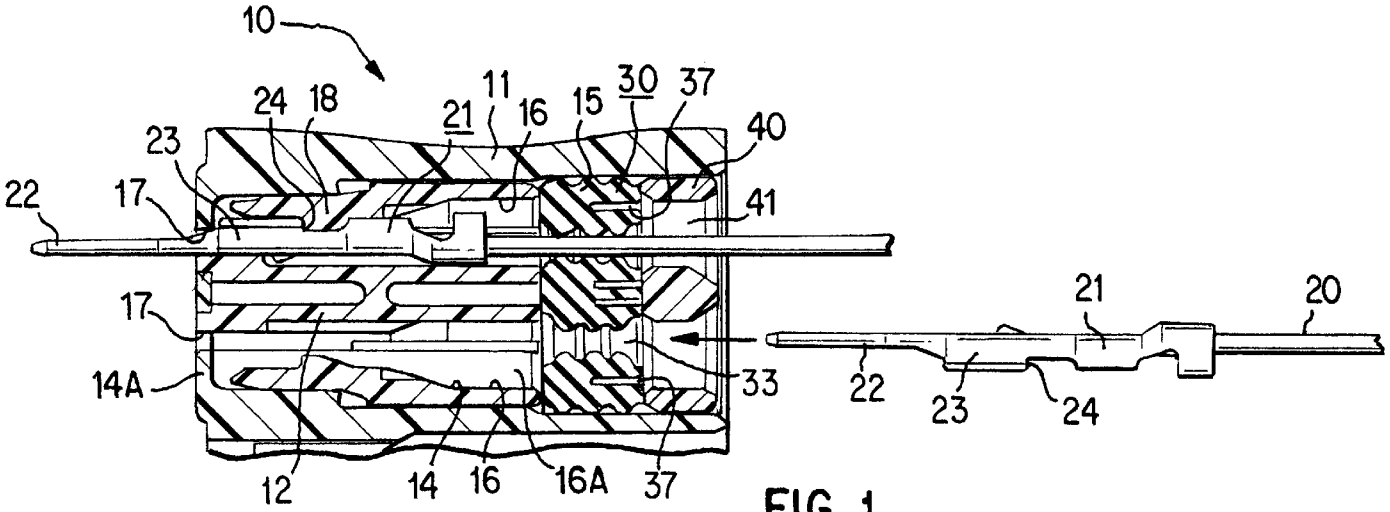
FIG. 1 is a cross-sectional view showing a terminal fitting being inserted into a connector of a first embodiment of the present invention.

A first embodiment of the present invention is described below with the aid of FIGS. 1 to 4. In this embodiment, a male waterproof connector is described. In FIG. 1, the number 10 refers to a connector housing which is made from plastic and is formed in two pieces from an outer housing 11 and an inner housing 12. An attachment hole 14 is formed within the outer housing 11, this attachment hole 14 having an anterior wall 14A that, cross-sectionally, has a horizontally extending oval shape. The inner housing 12 fits into an anterior side (the left side in FIG. 1) of the attachment hole 14. A rubber stopper attachment hole 15, into which a collective rubber stopper 30 fits, opens onto the posterior of the outer housing 11.

A plurality of cavities 16, these being provided as an upper and a lower row, are formed within the inner housing 12. Although this is not shown, one end, relative to the horizontal direction thereof, of the upper row of cavities 16 has no cavity, and the other end of the lower row of cavities 16 has no cavity. In place of these cavities, an attachment pole protrudes from a posterior face. A male terminal fitting 21, which has an end of an electric wire 20 fixed thereto, is inserted into each cavity 16 from an insertion hole 16A formed in a posterior end thereof. The male terminal fittings 21 are pushed in until tabs 22, at tip ends thereof, protrude to the anterior from openings 17 in the anterior wall 14A. When each male terminal fitting 21 has been pushed in to a correct position, whereby a main body 23 thereof reaches the anterior wall 14A, lances 18 formed on ceiling faces or base faces of the cavities 16 engage resiliently with members 24, thereby housing the male terminal fittings 21 in an unremovable state.

Figure 3:
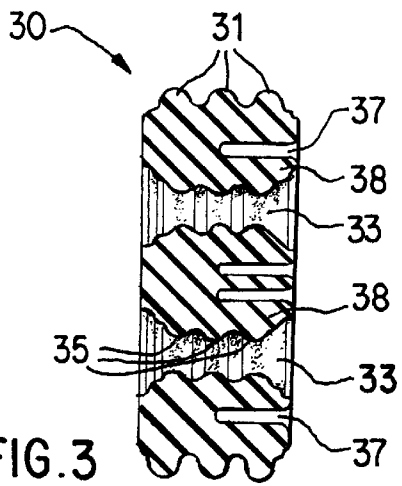
FIG. 3 is a cross-sectional view of the rubber stopper.
Figure 2:
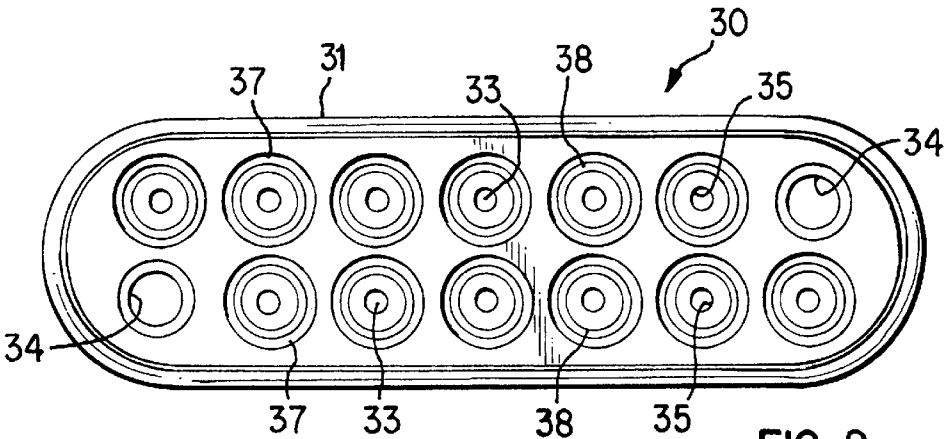
FIG. 2 is a front view of a rubber stopper.
Figure 4:
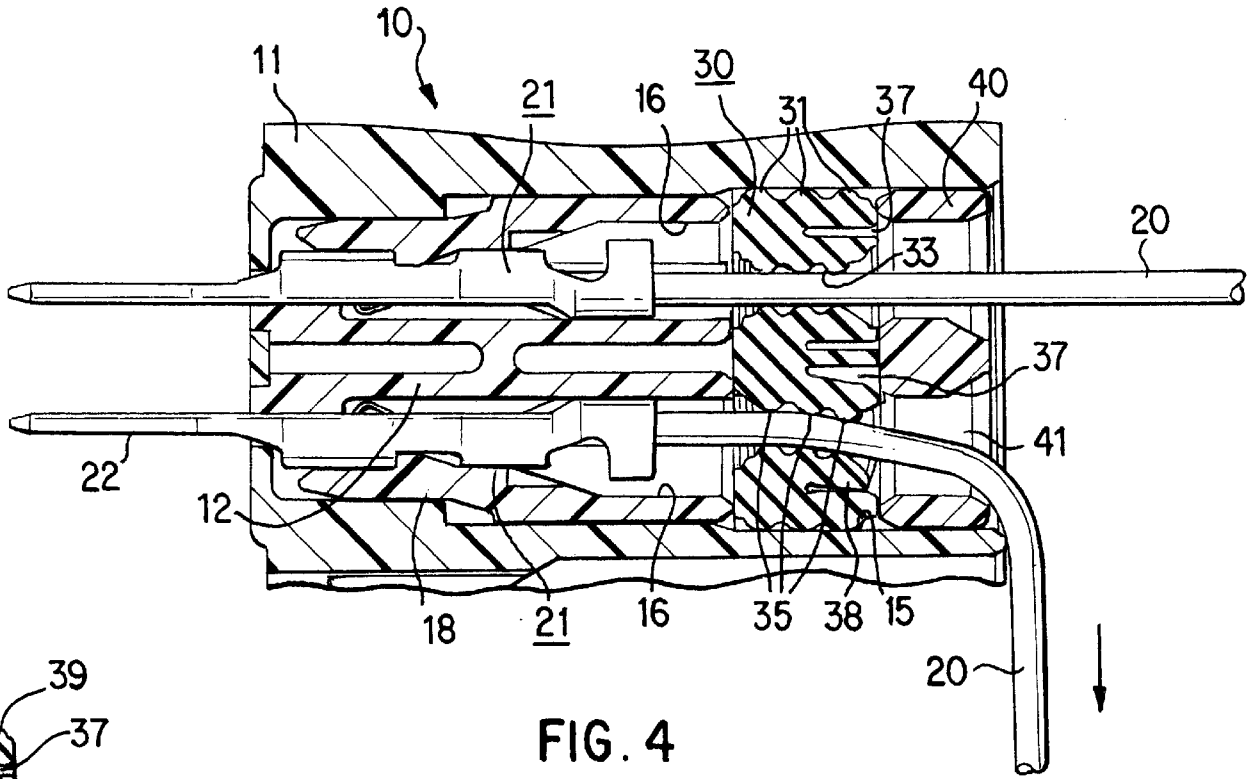
FIG. 4 is a cross-sectional view showing the connector in a state of use.

The rubber stopper attachment hole 15 is formed so as to extend along the entire length of the insertion holes 16A of the cavities 16. The collective rubber stopper 30 fits into an innermost side of the rubber stopper attachment hole 15. As shown in FIGS. 2 and 3, the rubber stopper 30 has a specified thickness, and has a horizontally extending oval shape when seen cross-sectionally. This allows it to be fitted tightly into the rubber stopper attachment hole 15. Three outer lips 31 are formed along an outer circumference face of the rubber stopper 30, as shown in FIG. 3.

Electric wire through holes 33 open into the interior portion of the rubber stopper 30 at locations corresponding to the cavities 16 of the inner housing 12. Attaching holes 34 open into the rubber stopper 30 at locations corresponding to the attachment poles which protrude, (i.e., at one end of the upper row of cavities 16 and at the other end of the lower row of cavities 16). The attachment poles can be fitted tightly into these attaching holes 34.

As shown, three inner lips 35 are formed along an inner circumference face of each electric wire through hole 33, these compressing resiliently so as to fit with outer circumference faces of the electric wires 20.

A ring-shaped groove 37 is formed concentrically around each electric wire through hole 33 on a posterior face of the rubber stopper 30, these grooves 37 extending into the rubber stopper 30 to a depth approximately half the thickness thereof. That is, a comparatively thin cylindrical member 38 extends along approximately half of the posterior part of each electric wire through hole 33.

A rubber stopper pushing member 40 is attached at the posterior of the rubber stopper 30. This rubber stopper pushing member 40 is made from plastic, and has a shape whereby it can be fitted tightly with an outermost end portion of the rubber stopper attachment hole 15. Window holes 41, which are formed in a grid shape and through which the male terminal fittings 21 can be inserted, are formed in the rubber stopper pushing member 40. The rubber stopper pushing member 40 is attached to the outermost end of the rubber stopper 30 by a retaining means (not shown), this preventing the rubber stopper 30 from being removed.

Next, the operation of the present embodiment is described. The attachment of the connector housing 10 is as follows: after the inner housing 12 has been fitted into the attachment hole 14 of the outer housing 11, the rubber stopper 30 is pushed into the rubber stopper attachment hole 15, the attachment poles at the posterior face of the inner housing 12 fitting into the attaching holes 34. The rubber stopper 30 is pushed in until it makes contact with the posterior face of the inner housing 12. The outer lips 31 of the rubber stopper 30 are compressed resiliently and fit tightly with an inner circumference face of the innermost side of the rubber stopper attachment hole 15. The electric wire through holes 33 are in a state whereby they join with the insertion holes 16A of each corresponding cavity 16. Further, the rubber stopper pushing member 40 is attached, thereby preventing the removal of the rubber stopper 30.

From this state, the male terminal fittings 21 are inserted into the corresponding cavities 16 in the direction shown by the arrow in FIG. 1. After the male terminal fittings 21 have passed through the window holes 41 of the rubber stopper pushing member 40, they are pushed through the electric wire through holes 33 of the rubber stopper 30, widening these electric wire through holes 33 as they are pushed therethrough; then the male terminal fittings 21 are inserted into the cavities 16 from the insertion holes 16A thereof. After the male terminal fittings 21 have been inserted to the correct position they are retained by the lances 18, and the electric wire through holes 33 of the rubber stopper 30 return to their original position, the inner lips 35 fitting tightly with the outer circumference of the electric wires 20. Attachment is complete after all the male terminal fittings 21 have been inserted, each cavity 16 being in a sealed state relative to the exterior.

The male waterproof connector that has been joined together in this manner is joined with, for example, a female waterproof connector (not shown). At this juncture, if the electric wires 20 are in a rotated state (as shown in the lower row in FIG. 4), whereby they are bent at a right angle to their axial direction, and a pulling force is exerted thereon, the electric wires 20 may be pulled in the direction of the arrow in FIG. 4.

In this case, the electric wires 20 are bent so as to exert a pulling force on the posterior end portions of the electric wire through holes 33. Since the electric wires 20 are in a state whereby they are fitted with the comparatively thin cylindrical members 38 at the posterior sides of the electric wire through holes 33, one of the grooves 37 narrows while the one on the opposing side thereof becomes wider. The cylindrical members 38 bend with the electric wires 20, and the seal between the inner lips 35 and the outer circumference of the electric wires 20 is maintained.

In this manner, even if a pulling force is exerted on the electric wires 20 that have been bent at a right angle to their axial direction, the cylindrical members 38 follow the bending of the electric wires 20, thereby maintaining a reliable and tight seal between the inner circumference faces of the electric wire through holes 33 and the outer circumference faces of the electric wires 20.

The grooves 37 are formed so as to surround the opening edges of the electric wire through holes 33 at the posterior face side thereof. Consequently, the rubber stopper 30, as a whole, retains its original thickness, and the size of the connector is not increased. Further, the electric wire through holes 33 easily grow wider as the male terminal fittings 21 are inserted therethrough or are removed therefrom, this allowing the insertion and removal processes to be performed easily.

Moreover, even in the case where the electric wire through holes 33 change shape, this changing shape has little effect on the outer portions thereof because the grooves 37 are cut into the electric wire through holes 33. Consequently, the outer lips 31 formed on the outer circumference face of the rubber stopper 30 maintain a tightly fitting state with the inner circumference face of the rubber stopper attachment hole 15 along the entire circumference thereof, thus maintaining the seal between the rubber stopper 30 and the rubber stopper attachment hole 15.

Figure 5:
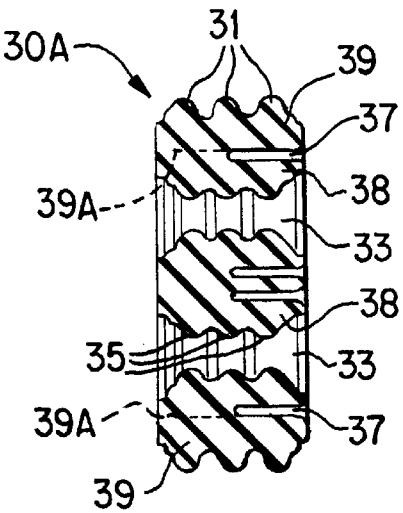
FIG. 5 is a cross-sectional view of a rubber stopper of a second embodiment.
Figure 6:
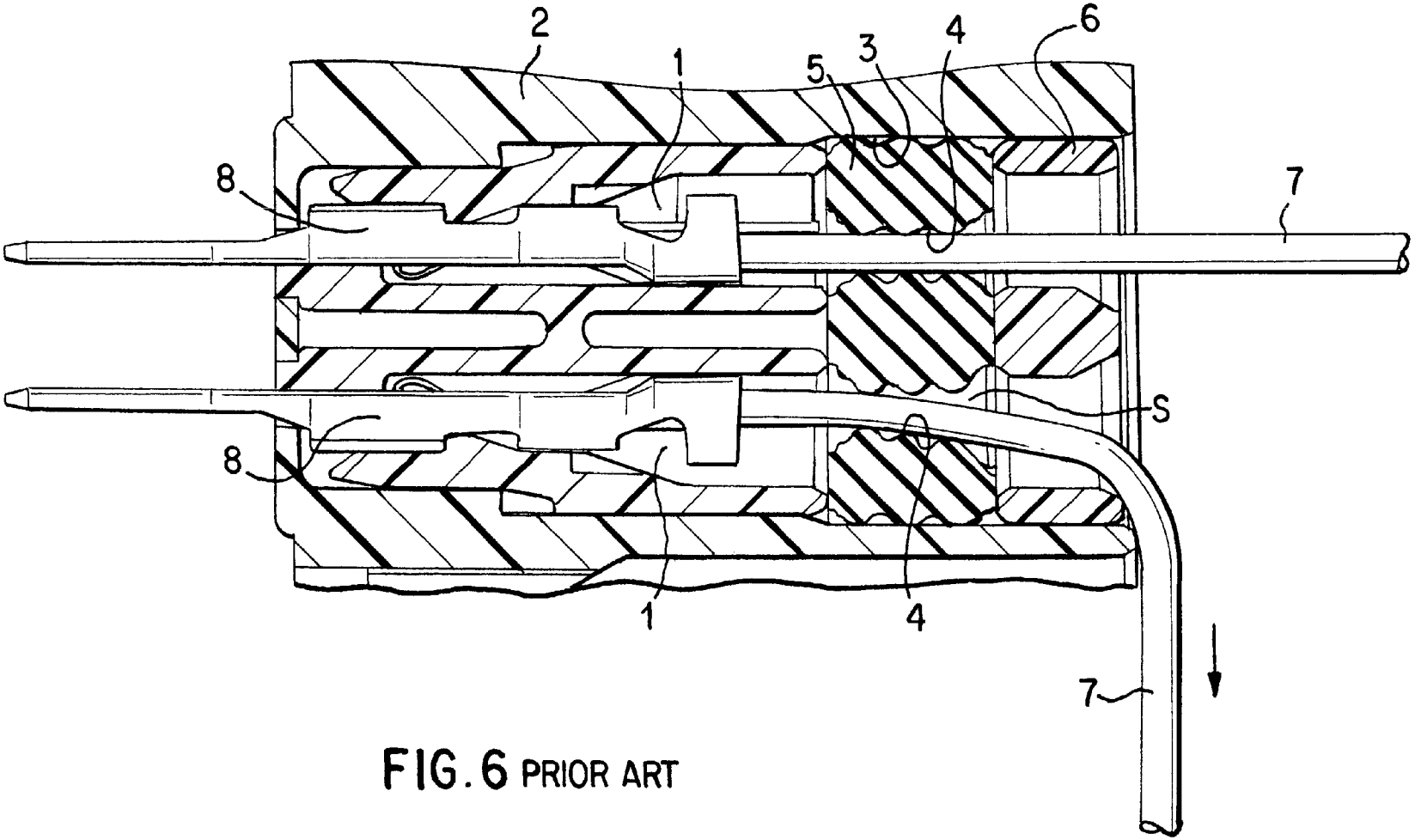
FIG. 6 PRIOR ART
FIG. 6 is a cross-sectional view of a prior art example.

FIG. 5 shows a second embodiment of the present invention. In this second embodiment, a rubber stopper 30A has outer lips 31 and an outer circumference annulus 39 (located outwards relative to the broken line 39A) which are made from bi-colour moulding and are more rigid than the other components. The remaining configuration is the same as the first embodiment.

In the rubber stopper 30A of the second embodiment, the outer lips 31 and the outer circumference annulus 39 are moulded so as to be more rigid. Consequently, when the electric wire through holes 33 change shape, the outer circumference annulus 39 does not change shape therewith as a result of being pulled. The outer lips 31 maintain a tightly fitting state, and the seal between the rubber stopper 30A and the rubber stopper attachment hole 15 is reliably maintained.

The present invention is not limited to the embodiments described above with the aid of figures. For example, the possibilities described below also lie within the technical range of the present invention. In addition, the present invention may be embodied in various other ways without deviating from the scope thereof.

(1) In the embodiments described above, the connector housing was formed from two pieces, an outer housing and an inner housing. However, the connector housing may equally well be formed from a single piece.

(2) The present invention is equally suitable for a female waterproof connector.

What is claimed is:

1. A resilient waterproofing stopper for a wire receiving opening of an electrical connector, said stopper comprising a body having an inner side, an outer side, a plurality of holes therethrough, said holes being sized to resiliently engage a respective electrical wire, wherein a ring-like blind recess surrounds each of said holes at the outer side thereof, each recess configured to remain open when the stopper is inserted into a wire receiving opening of an electrical connector and configured such that when a respective electrical wire engaged by a respective hole is pulled to one side, one side of the recess narrows and an opposite side of the recess widens such that the respective hole remains in resilient engagement with the respective electrical wire.

2. A stopper according to claim 1 wherein each said blind recess extends to half a depth of said stopper.

3. A stopper according to claim 1 wherein each of said holes includes circumferentially extending ribs on the inside thereof.

4. An electrical connector comprising a body having an annular hood thereon, a plurality of electrical wires protruding to the exterior via said hood, and a waterproofing stopper according to claim 1 within said hood, each of said wires passing through a respective hole in said stopper.

5. A stopper according to claim 1, further including circumferentially extending lips around the periphery of the stopper for engagement with an opening of an electrical connector.

6. A stopper according to claim 5, wherein said lips and an annulus of said stopper immediately adjacent to said lips are substantially less resilient than a remaining part of said stopper.

7. A stopper according to claim 5 and co-moulded of rubber materials of different resilience.

8. A stopper according to claim 6 and co-moulded of rubber materials of different resilience.

9. A stopper according to claim 5, wherein said lips are substantially less resilient than a remaining part of the stopper.

10. A stopper according to claim 7 wherein said co-moulding comprises rubber materials of different colour.

11. A stopper according to claim 8 wherein said co-moulding comprises rubber materials of different colour.

12. An electrical connector comprising:

a housing having a wire receiving opening;

a resilient waterproofing stopper inserted into the wire receiving opening and comprising a body having an inner side, an outer side, a plurality of holes therethrough, said holes being sized to resiliently engage a respective electrical wire, and a ring-like blind recess surrounding each of the holes at an outer side thereof;

wherein each ring-like blind recess remains open when the resilient waterproofing stopper is inserted into the wire receiving opening, and each blind recess is configured such that when a respective electrical wire engaged by a respective hole is pulled to one side, one side of the blind recess narrows and an opposite side of the blind recess widens such that the respective hole remains in resilient engagement with the respective electrical wire.

13. An electrical connector according to claim 12, wherein each said blind recess extends to half a depth of said stopper.

14. A stopper according to claim 12 wherein each of said holes includes circumferentially extending ribs on the inside thereof.

15. An electrical connector according to claim 12, further including circumferentially extending lips around the periphery of the stopper for engagement with the wire receiving opening.

16. An electrical connector according to claim 15, wherein said lips are substantially less resilient than said stopper.

17. An electrical connector according to claim 15, wherein said lips and an annulus of said stopper immediately adjacent to said lips are substantially less resilient than a remaining part of said stopper.

18. An electrical connector according to claim 15, wherein said stopper and said lips are co-moulded of rubber materials of different resilience.

19. An electrical connector according to claim 18, wherein said co-moulding comprises rubber materials of different color.

20. An electrical connector comprising a body having an annular hood thereon, a plurality of electrical wires protruding to the exterior via said hood, and a waterproofing stopper according to claim 12 within said hood, each of said wires passing through a respective hole in said stopper.

* * * * *